US006663436B1

(12) United States Patent
Arnett et al.

(10) Patent No.: US 6,663,436 B1
(45) Date of Patent: Dec. 16, 2003

(54) HIGH FREQUENCY TELECOMMUNICATION CONNECTOR

(75) Inventors: Jamie R. Arnett, Fishers, IN (US); Robert R. Goodrich, Indianapolis, IN (US); David L. Reed, Fountaintown, IN (US); Paul J. Straub, Mooresville, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 26 days.

(21) Appl. No.: 10/197,186

(22) Filed: Jul. 17, 2002

Related U.S. Application Data

(63) Continuation of application No. 10/055,401, filed on Jan. 23, 2002, now abandoned.

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS 6,457,994 B1 * 10/2002 Johnson et al. ..... 439/492

* cited by examiner

*Primary Examiner*—Renee Luebke
*Assistant Examiner*—Ann McCarney
(74) *Attorney, Agent, or Firm*—Cohen, Pontani, Lieberman & Pavane

(57) ABSTRACT

In accordance with the invention, there is provided a telecommunication jack that is free of cross-over sections, has cross-talk characteristics that approach Category 6 levels, and avoids the use of spring contact wires supported in a cantilevered fashion. This is achieved in a preferred implementation by spring terminal contact wires that are arch shaped. Each spring wire has a first leg having an end, a second leg having an end and an apex portion located between the first and second legs where the ends of the legs are supported on a wire board and each end makes electrical contact with separate conductive pads. When utilized in an operating circuit, one end and leg of a spring terminal contact wire is coupled to a conductive pad on the wire board that is in a current carrying signal path, and the other end and leg of that spring terminal contact wire is coupled to a different conductive pad on the wire board adapted for connection to a cross-talk compensating component. In accordance with the invention, both pads of the wire board are connected to a common spring terminal contact wire, although only one pad and one leg of the arch shaped spring wire may be in the current carrying signal path. The legs of the arch shaped spring terminal contact wires can be of equal or unequal length, the arch can be semi-circular, triangular or the like, and the conductive pads on the wire board of adjacent spring wire terminals can be either aligned or staggered in distance from the edge of the wire board.

18 Claims, 6 Drawing Sheets

HIGH FREQUENCY TELECOMMUNICATION CONNECTOR

CROSS-REFERENCE TO RELATED APPLICATION

This is a continuation of U.S. patent application Ser. No. 10/055,401 filed Jan. 23, 2002, now abandoned.

BACKGROUND OF THE INVENTION

1. Field of the Invention

The present invention relates generally to wire and cable connectors and, more particularly, to electrical connectors for communication circuits that compensate for cross-talk along different signal paths within the connector.

2. Description of the Related Art

Connectors for communication wires and cables are normally used to connect the ends of pairs of wires which define discrete signal paths. A typical industry type of communication connector is the RJ-45 communication connector. This connector contains eight wires to provide four pairs of terminal wires where each pair of wires defines a single signal path. Within the typical RJ-45 connector, the eight wires which make up the four pairs of conductors are closely spaced and normally follow paths which are parallel to each other for the length of the connector body. This close positioning of the wires strongly suggests that cross-talk may be induced between and among different pairs of wires within the RJ-45 connector. As broadly defined herein, cross-talk occurs when signals conducted over a first signal path, e.g., a pair of terminal contact wires within a connector, are partly transferred by inductive or capacitive coupling into a second, adjacent signal path (e.g., another pair of terminal contact wires) within the connector. The transferred signals are delineated as "cross-talk" in the second signal path, and they act to degrade other signals that are being routed through the second path.

Applicable industry standards for rating the extent to which communication connectors exhibit cross-talk do so in terms of so-called near end cross-talk (NEXT). Such ratings are typically specified for a mated pair of connectors, e.g., a type RJ-45 plug and jack combination, where the input terminals of the plug connector are used as a reference plane.

U.S. Pat. No. 5,186,647, which is assigned to the assignee of the present invention, discloses an electrical connector for conducting high frequency signals. The connector has a pair of metallic lead frames mounted flush with a dielectric spring block, with connector terminals formed at opposite ends of the lead frames. The lead frames themselves include flat elongated conductors, each of which includes a spring terminal contact wire having a free end supported in cantilever fashion for contacting a corresponding terminal wire of a mating connector, and an insulation displacing connector terminal at the other end for connection with an outside insulated wire lead. The lead frames are placed over one another on the spring block, and three conductors of one lead frame have cross-over sections configured to overlap corresponding cross-over sections formed on three conductors of the other lead frame.

It is also known to provide cross-talk compensating circuitry on or within layers of a printed wire board to which spring terminal contact wires of a communication jack (also supported in cantilevered fashion) are connected within the jack housing. See U.S. Pat. Nos. 5,997,358 and 6,176,741.

Communication links using unshielded twisted pairs of copper wire are now expected to reliably support data rates up to not only 100 MHz, i.e., industry standard "Category 5" performance, but up to as much as 250 MHz or proposed "Category 6" performance levels.

The use of spring terminal contact wires supported in a cantilevered fashion can contribute to circuit discontinuity caused by bent contacts, that are not aligned, or that make high impedance physical contact. The use of cross-over conductors that follow irregular paths in a connector are expensive to manufacture and assemble.

Accordingly, there is a clear need for a communications connector that has cross-talk characteristics that approach Category 6 levels, that does not require complex cross-over sections, that is adaptable for connection to cross-talk compensation circuitry on or within layers of a printed wire board to which spring terminal contact wires of a communication jack are connected within the jack housing, that avoids the use of spring terminal contact wires having a free end supported in cantilevered fashion, and that is simple in design and economical to produce.

SUMMARY OF THE INVENTION

In accordance with the invention, there is provided a telecommunication jack that is free of cross-over sections, has cross-talk characteristics that approach Category 6 levels, and avoids the use of spring contact wires supported in a cantilevered fashion. This is achieved in a preferred implementation by spring terminal contact wires that are arch shaped. Each spring wire has a first leg having an end, a second leg having an end and an apex portion located between the first and second legs where the ends of the legs are supported on a wire board and each end makes electrical contact with separate conductive pads. When utilized in an operating circuit, one end and leg of a spring terminal contact wire is coupled to a conductive pad on the wire board that is in a current carrying signal path, and the other end and leg of that spring terminal contact wire is coupled to a different conductive pad on the wire board adapted for connection to a cross-talk compensating component. In accordance with the invention, both pads of the wire board are connected to a common spring terminal contact wire, although only one pad and one leg of the arch shaped spring wire is in the current carrying signal path; the pad and leg connected to the cross-talk compensating component is not in the current carrying signal path. The legs of the arch shaped spring terminal contact wires can be of equal or unequal length, the arch can be semi-circular, triangular or the like, and the conductive pads on the wire board of adjacent spring wire terminals can be either aligned or staggered in distance from the edge of the wire board.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like numerals identify similar elements throughout the several figures.

DETAILED DESCRIPTION OF THE PRESENTLY PREFERRED EMBODIMENTS

Figure 1:
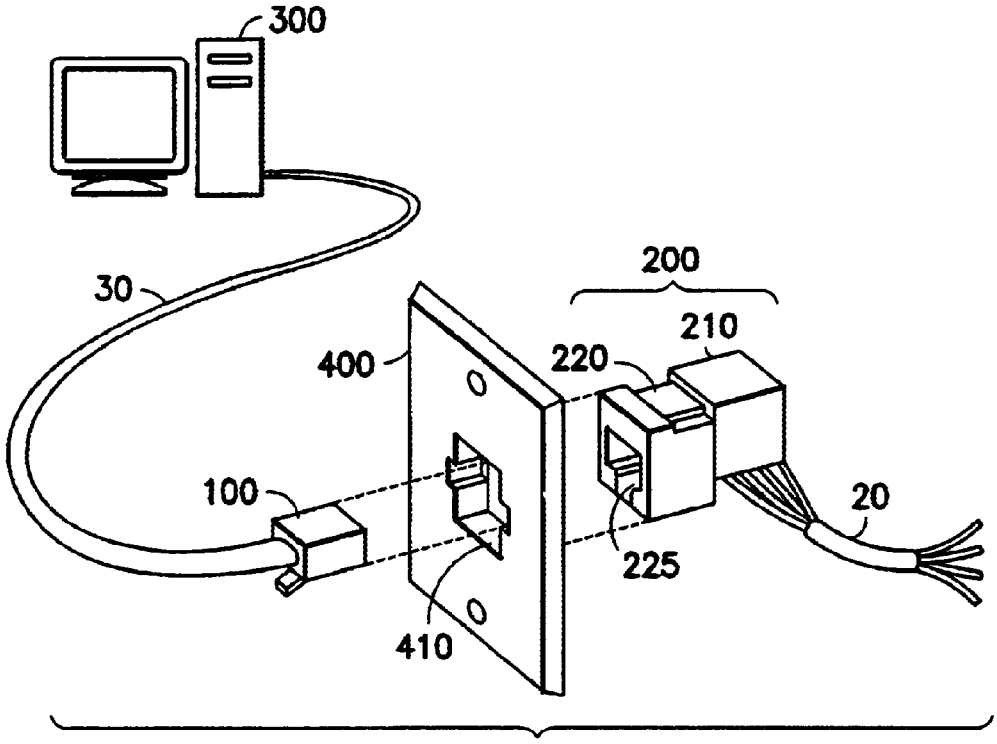
FIG. 1 PRIOR ART
FIG. 1 is an elevated perspective view of a conventional communication connector assembly, and a conventional jack housing into which the connector assembly can be inserted and mounted.

FIG. 1 depicts an assembly of interconnecting hardware which may be used in an electrical communication system. Thus, this hardware may for example be used to interconnect a high speed computer station 300 to an electrical cable 20 via standard telecommunications connecting apparatus such as a cord 30, a modular plug 100, and a modular jack 200. Illustrative specifications for such plugs and jacks can be found in subpart F of the FCC Part 68.500 Registration Rules. Modular jack 200 comprises a spring block assembly 210 and a jack housing 220 that interlock together to provide a convenient receptacle for receiving and releasably retaining the modular plug 100. Spring block assembly 210 includes a number of electrically conductive paths. The conductive paths terminate, at one end, in flexible arch shaped spring terminal contact wires having two legs connected together at an apex (hereinafter "jack springs") that may be formed, for example, from a conductive resilient material such as beryllium-copper. The jack springs are arranged within the modular jack for electrical contact with a corresponding array of metallic blades 120 within the modular plug (see FIG. 2). The conductive paths terminate in insulation-displacement connectors, at the other or opposite end, that make electrical contact with the wires in cable 20.

An opening 225 in the front end of jack housing 220 is shaped to receive the modular plug 100, which is inserted and retained therein. Although the modular plug is configured to be positionably captured within the modular jack via cantilever latch 130 (see FIG. 2), its blades 120 may contact the jack springs anywhere over a range of positions, depending upon the depth to which the plug is inserted into the jack.

Figure 2:
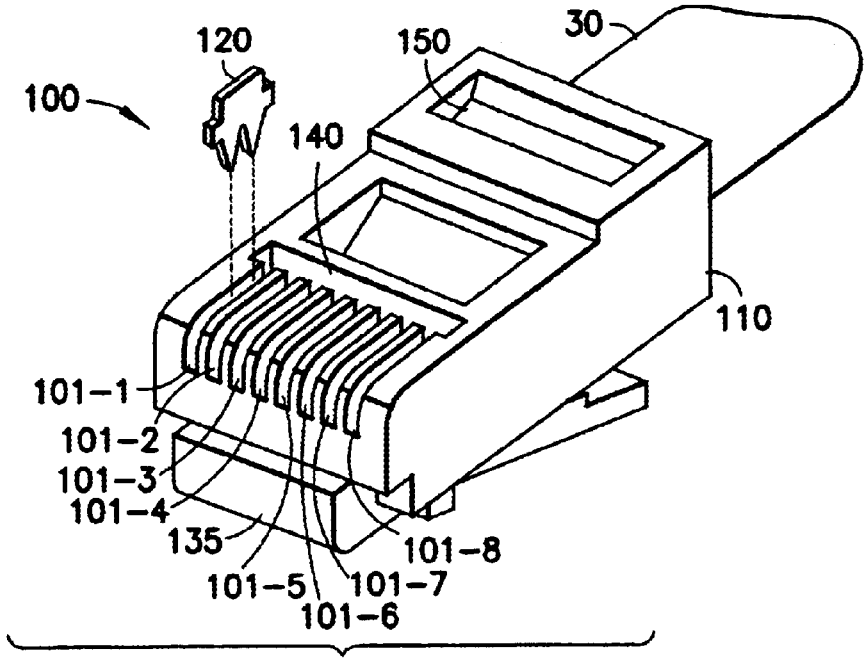
FIG. 2 PRIOR ART
FIG. 2 is an enlarged, elevated perspective view of a front portion of the connector assembly of FIG. 1.

FIG. 2 is an elevated perspective view of a conventional prior art modular plug 100, illustrating its general construction. Modular plug 100 comprises a dielectric plug housing 110 having a number of metallic terminals 120 which are inserted into a plurality of terminal-receiving slots. In FIG. 2 there are eight such slots (101-1 through 101-8) that extend downward from the top of the housing into conductor-receiving ducts that hold the wires from cord 30. Plug housing 110 includes a rigid front surface 135 and a conductor strain relief member 140 which is deflected downward during assembly to anchor the conductors in engagement with the bottom of a chamber within the plug. Plug housing 100 further includes a jacket strain relief member 150 which is similarly deflected downward during assembly to provide strain relief for the jacket of cord 30. A cantilever latch 130 is operable for releasably locking the plug 100 with modular jack 200.

Figure 3:
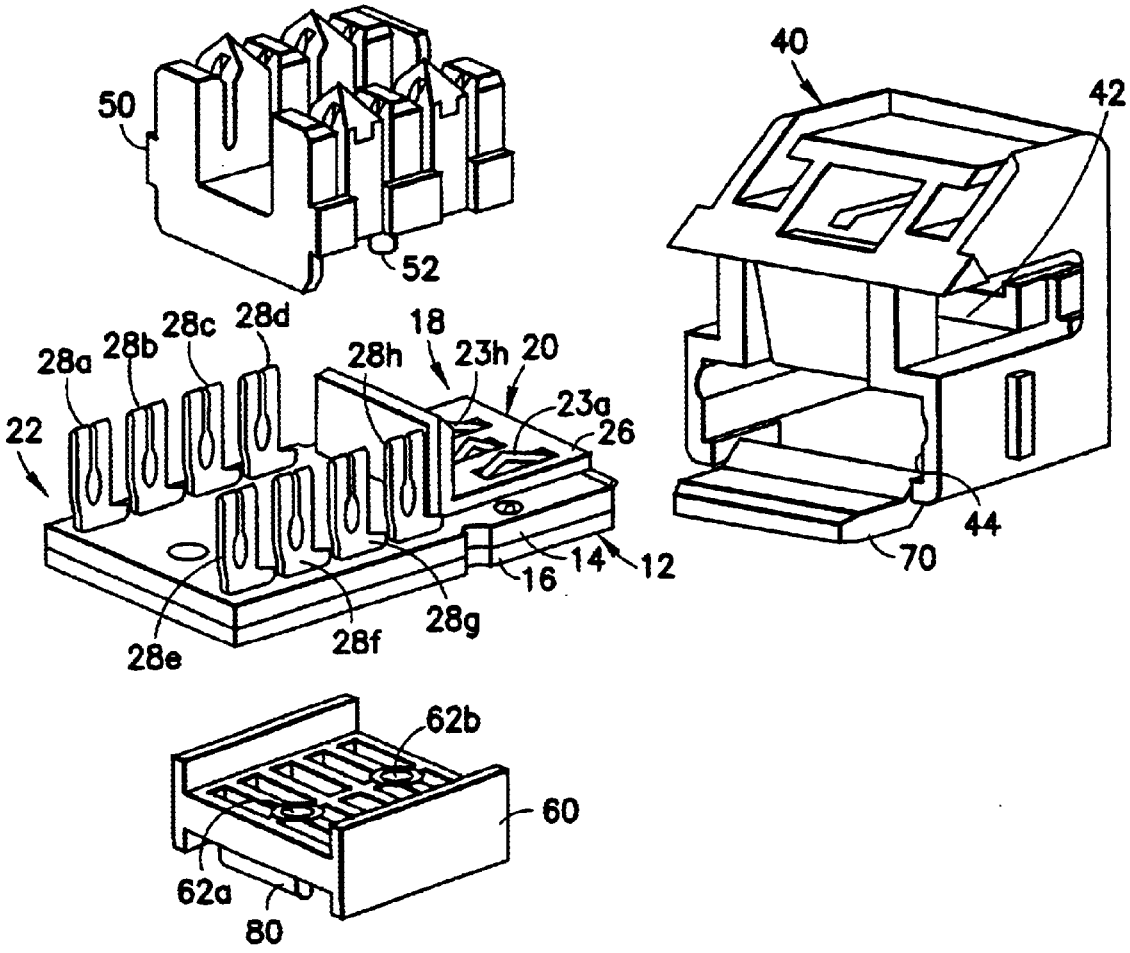
FIG. 3 is an exploded elevated perspective view of a high frequency communication jack assembly in accordance with the invention.

FIG. 3 is an exploded view of a high frequency communication jack 200 in which the jack springs of the present invention are implemented . The jack 200 includes a printed wire board 12, which is preferably multi-layered. Although a double sided printed wiring board 12 is shown in FIG. 3, the wire board 12 may alternatively be single sided or have multiple layers depending on the desired cross-talk reduction scheme to be utilized. In FIG. 3, wire board 12 has conductive paths (see FIG. 7) on the sides 14,16, which paths extend between pads at a jack wire terminal region 18 near a front edge 20 of the board 12, and a wire connection terminal region 22 at a rear portion of the board.

A number, as for example eight, of jack wires 23*a* to 23*h* (see FIG. 4) extend through the jack wire holding block 26 at an acute angle relative to the top surface of the holding block for connection with a communication plug when the plug is placed in the jack wire terminal region 18. The jack wires 23*a*–23*h* connect at their bottom ends via conductive pads to corresponding conductive paths of the wire board 12 (see FIGS. 6 and 7) so that the conductive paths form a part of one or more communication signal paths when the communication plug is connected with the jack wires.

Preferably, the conductive paths associated with wire board 12 are configured individually or in combination with other discrete components such as resistors, capacitors and/or inductors to compensate for or reduce cross-talk that will otherwise developed a communication signal path when the plug is connected with the jack wires.

The bottom ends of the jack wires 23*a*–23*h* slidably connect through conductive pads to conductive paths on the wire board. The following details of the jack wire holding block 26 and the jack wires 23*a*–23*h* are described in connection with FIGS. 4, 5 and 6. Preferably, the bottom end of each jack wire has a turned up radius surface that allows the end to slidably contact a negative conductive pad on the wire board 12. This construction provides a reliable electrical connection between the ends of the jack wires and the conductive pads without the need for soldering.

Insulation displacement connector (IDC) terminals 28*a* to 28*h* are mounted at both rear sides of the wire board 12 as shown in FIG. 3. Each of the terminals 28*a*–28*h* connects to a corresponding path associated with a different respective one of the jack wires 23*a*–23*h*. A pair of terminal housing mounting holes are formed in the wire board 12 along an approximate center line defined between the rear edges of the board. A jack frame 40 similar to the one disclosed in U.S. Pat. No. 5,096,442 may be employed as the jack frame 40 of FIG. 3. Jack frame 40 has a front opening 42 which faces toward the right rear side in FIG. 3. Frame 40 also has a rear opening or cavity 44 dimensioned to receive the forward edge 20 of wire board 12, including the jack wires 23*a*–23*h*. The jack wires connect with and are deflected when plug 100 is positioned through the frame front opening 42 into the jack wire terminal region 18 over wire board 12. Wire conductors carried by the inserted plug thus establish electrical contact with corresponding ones of the jack wires 23*a*–23*h*.

An electrically insulating or dielectric terminal housing 50, also seen in FIG. 3, is formed to protect and permit wire lead access to the wire connection terminal region 22 atop the wire board 12. The housing 50 may for example be formed of a plastic material that meets all applicable standards with respect to electrical insulation and flammability, such plastics as polycarbonate, ABS, and blends thereof. Housing 50 has pair of fastening or mounting posts 52 that project from a bottom surface of the housing. When housing 50 is aligned with the IDC terminals 28*a*–28*h* on wire board 12 and lowered to surround the terminals, the fastening posts 52 align with the rear openings in board 12 and pass through them to project outwardly beyond the bottom of the board.

A cover 60 is formed of a material that may be the same or similar to that of housing 50 and jack frame 40 and protects the bottom of board 12 at the connection terminal region 22. Cover 60 has a pair of openings 62*a*, 62*b* formed along an appropriate center line defined between the sides of the cover to align with tips of the housing fastening posts 52 that project below the wire board 12. Wire board 12 is sandwiched or captured between the housing 50 and cover 60, and the tips of the mounting posts 52 are preferably joined to the body of cover 60 by, for example, an ultrasonic shear joint is formed with mounting post 52 and cover holes 62*a*, 62*b*. The tips of the mounting posts 52 and surrounding cover body melt and fuse with one another to form solid joints when cooled. With wire board 12 thus captured between housing 50 and cover 60, substantially the entire wire connection terminal region 22 of board 12 is protectively enclosed.

Jack frame 40 has a latch 70 that protrudes below the rear opening 44 (FIG. 3). Cover 60 has a pair of shoulders 80 adjacent the front and rear edges of cover. Once housing 50 is joined to cover 60 with wire board 12 captured between them, the front edge 20 of the wire board 12 is inserted in the rear cavity 44 of jack frame 40 until frame latch 70 snaps over and onto an adjacent shoulder 80 on the bottom of cover 60.

Figure 4:
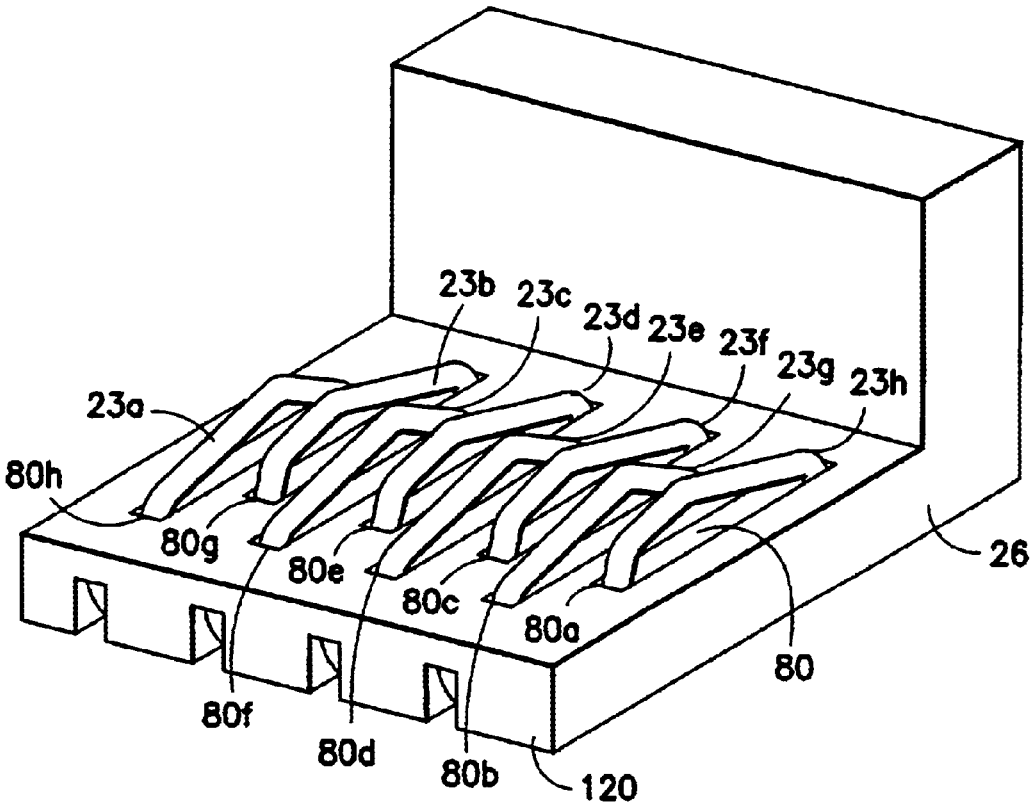
FIG. 4 is an elevated perspective view of the jack wire spring contacts-jack wire block assembly of the invention.

FIG. 4 is a perspective-enlarged view of the jack wire holding member 26 and captive jack springs 23*a*–23*h* of FIG. 3. The jack wire holding block can be formed of an insulating material such as a non-conducting plastic configured, for example, by molding to provide eight jack wire holding slots 80*a*–80*h*, one for each jack wire in jack wire holding member 26. The slots extend through the jack wire holding block and are positionably staggered to position the forward end of alternate slots close to the front edge 120 of the jack wire holding block. Thus, as seen in FIG. 4 the forward edges of slots 80*b*, 80*d*, 80*f* and 80*h* are located relatively close to the block front edge 120, and the forward edges of slots 80*a*, 80*c*, 80*e* and 80*g* are located relatively rearward from the front end 120 of the holding block.

Figure 5:
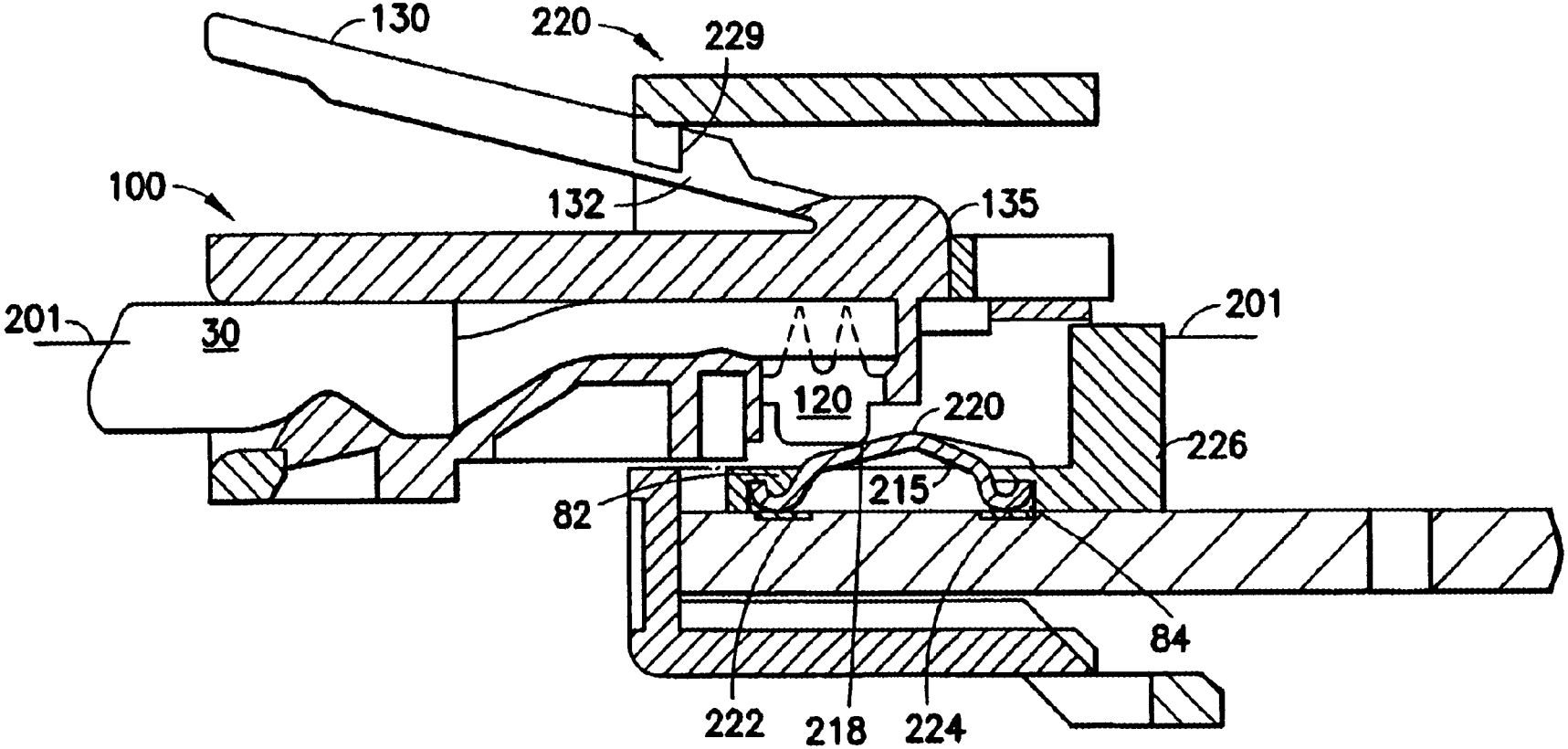
FIG. 5 is a side cross sectional view of an embodiment of the invention with the modular plug installed within the modular jack.

Referring now to FIG. 5, at the top surface of the jack wire holding block the width of each slot is sized to allow a jack wire to be held captive without binding. The slot length is sized to permit the apex 220 portion of the jack wire to protrude beyond the top surface of the holding block but not sufficiently large as to allow the jack wire to escape from the slot. At the bottom surface of the holding block, the width of each slot is the same as the top surface, but the length of each slot is expanded to provide a holding member 82 and a holding chamber 84. Holding member 82 is located within the front interior end of each slot, and holding chamber 84 is located within the rear interior end of each slot. Jack wire holding member 82 is adapted to engage and hold captive an end of one leg of a jack wire and the holding chamber is adapted to restrain the end of the other leg of the jack wire to prevent it from escaping from the slot while permitting it to move longitudinally within the slot.

Figure 6:
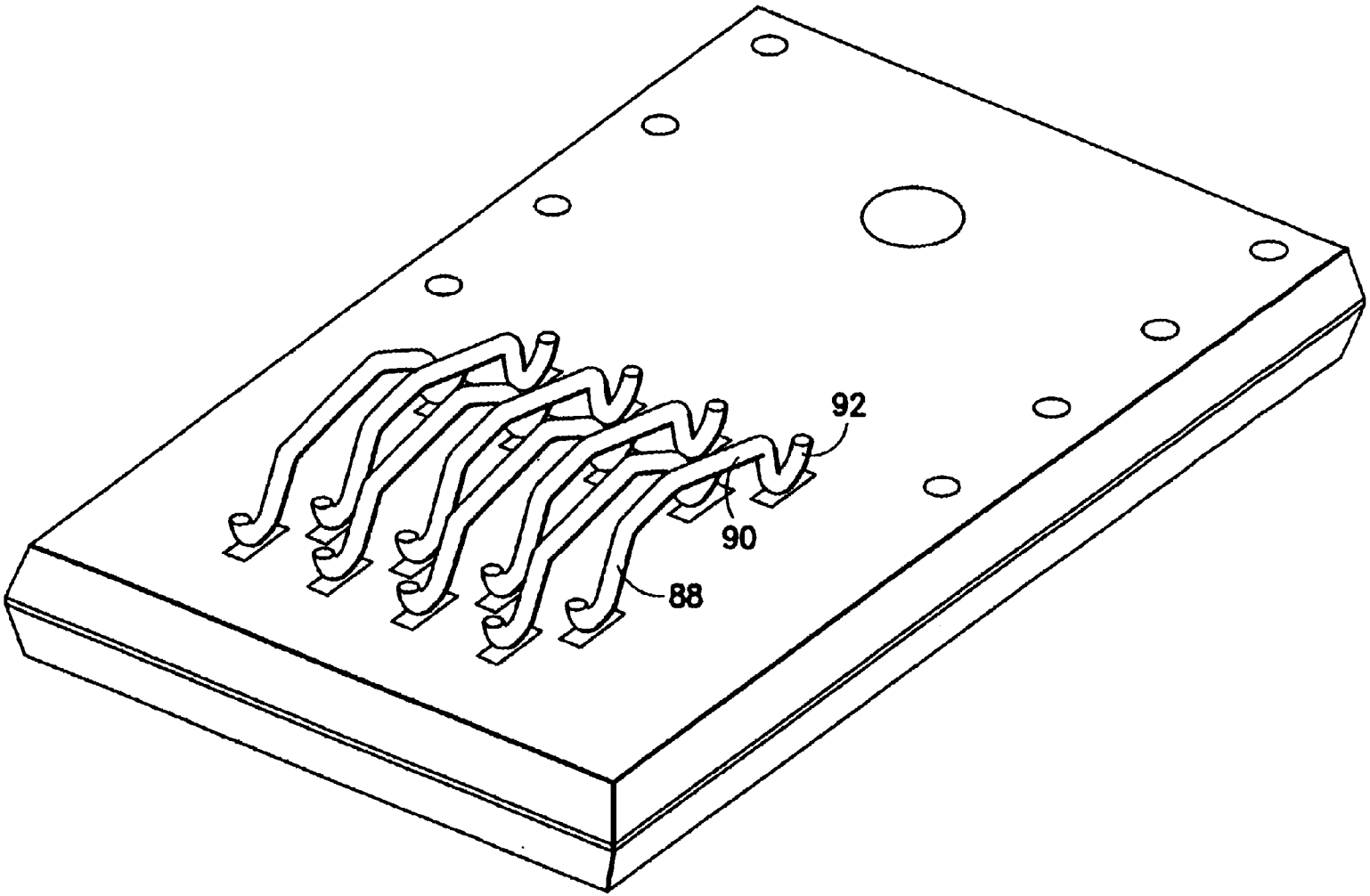
FIG. 6 is an elevated perspective view of the inventive jack wire spring contacts positioned on, and making contact with conductive pads on a printed wiring board.

FIG. 6 presents an enlarged perspective view of the arch shaped jack spring wires positioned on the top surface of a wire board. The jack spring wires have an asymmetric arch shape formed by two legs 88, 90 of unequal length. In the embodiment shown in FIG. 6, leg 90 is longer than leg 88. The end 92 of each leg has a turned up bend to define a hook, as for example, in the shape of a semi-circle. The radially exterior lower surface of the semi-circular end of each leg is adapted for slidable contact with a conductive pad located on the top surface of the wire board. The radially interior surface of the hook or semi-circular end of one of the legs, when positioned within a jack holding slot, is adapted to be positioned around and engaged by the holding member 82 (FIG. 5). The other end of that jack wire is located within and held captive in the slot by holding chamber 84. As seen in FIG. 5, one leg of each jack spring is free to move longitudinally along the rectangular shaped slot, but is restricted against widthwise movement.

Figure 7:
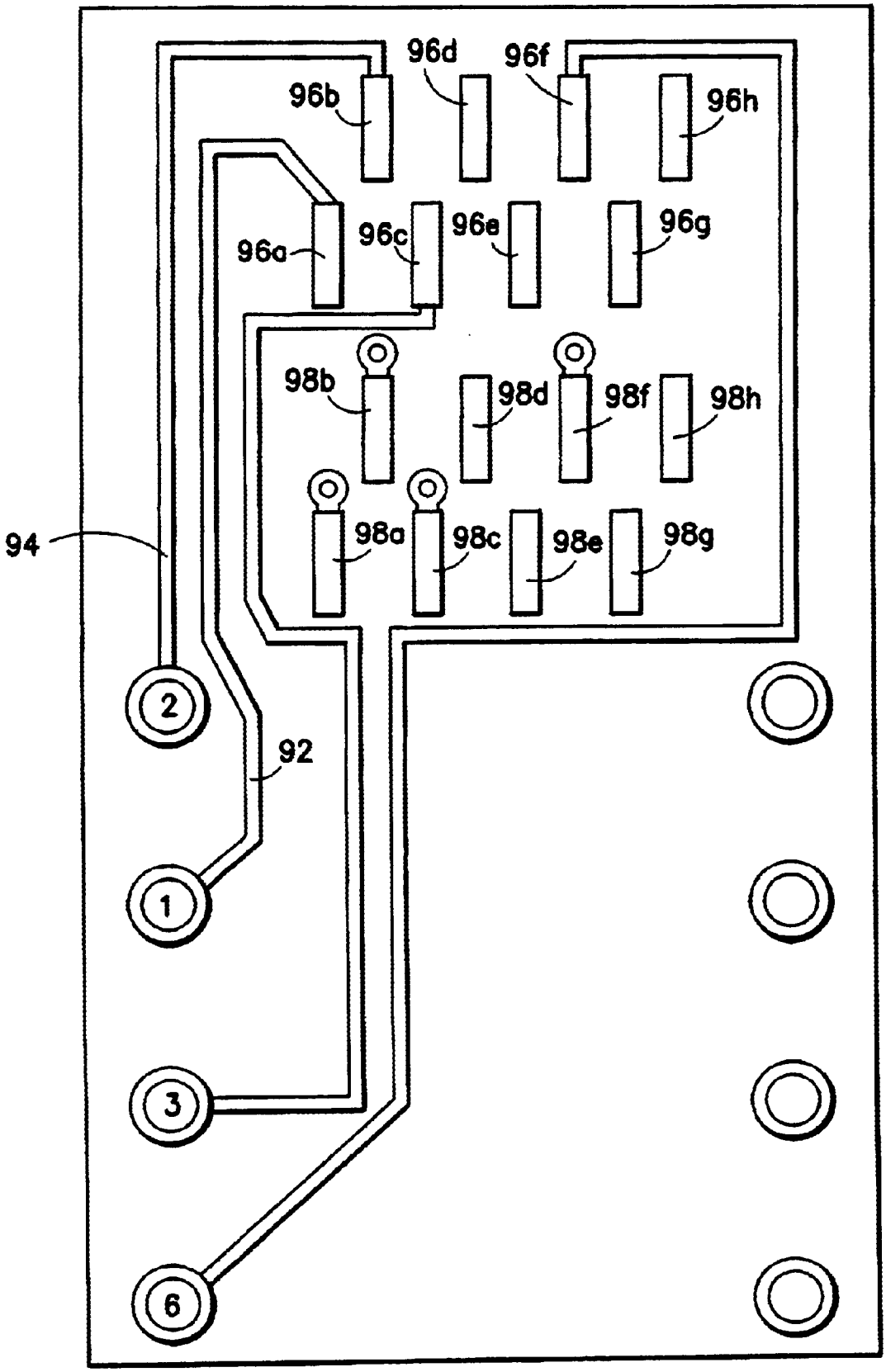
FIG. 7 is a top plan view of a printed wiring board for use with the spring contacts of the invention.

FIG. 7 shows the top surface of the wire board 12, which is, as herein disclosed, if formed of two layers. It should nevertheless be understood that the wire board can have more or fewer than eight layers of wiring paths for introducing compensating cross talk, and each layer can comprise one or more metallic paths positioned on a dielectric material as is known in the art. Briefly, as illustrated, multiple printed wiring boards are joined into a single unit by an epoxy layer in a manner known in the art. Each printed wiring board comprises a board material, such as FR-4, with conductive paths patterned on its top and bottom surfaces by standard techniques such as photolithography. Although, two layers of conductor paths are shown in this illustrative embodiment it will be appreciated that any number of layers can be employed with vias to connect to inner circuit layers.

The top surface of the wire board of FIG. 7 carriers sixteen conductive pads, two for each jack wire. With the illustrated eight jack wires, therefore, the wire board carriers sixteen conductive pads. The eight conductive pads located at the front of the wire board, i.e., conductive pads 96*a*–96*h* are connected to conductive paths which can be either on the top surface or on an intermediate layer or surface of the wire board. The eight conductive pads located at the rear of the board, i.e., conductive pads 98*a*–98*h*, are connected to conductive paths that are located on an intermediate surface of the wire board for connection to cross-talk compensating components such as inductors, resistors and/or capacitors.

Returning to FIG. 5, an embodiment of the interconnected modular plug 100 and modular jack 200 is shown. As the plug is inserted into the jack, the forward end of the plug blades 120 contact the jack wires 23*a*–23*h* at a contact point 218 that is located in front of and below the apex 220 at which the two legs of the jack wires are joined. Continued insertion of the plug into the jack causes the blades 120 to push against the jack wires to force the jack wire legs 215, 218 to spread apart and press down against the conductive pads. As the legs spread, at least one leg (normally the unrestrained leg) will slide on and along its cooperating conductive path. Thus, engagement of the blades of the plug with the jack wires provides positive contact pressure between the blades and jack wires and the spreading of the legs of the jack wires creates a wiping action between the ends of the jack wires and the conductive pads 222, 224 on the wire board. As illustrated in FIG. 5, each jack wire has an asymmetric arch shape formed by the two legs 215, 218 of unequal length. Additionally, the end of each leg is turned up to form a hook which can take the shape of a semi-circular or the like to help retain the jack wires in the jack wire holding block and to provide a sliding contact surface with conductive pads on the wire board. The radially inner surface of the hook or semi-circular end of one leg is adapted to be engaged by a jack wire engaging member 82 of holding block 26, and the end not restrained by wire engaging member 82 makes sliding contact with a cooperating contact located on the surface of the wire board. It should be noted that the wire engaging member 82 can be alternatively eliminated and the jack wires permitted to float within the cavity formed by the slot in the jack wire holding block to allow the two ends, rather than only one end, of the jack wire to make sliding contact with the contact pads on the wire board. In still another embodiment, the two legs 215, 218 can be of substantially equal length and the slots in holding block 26 not staggered but, instead, aligned with their front ends substantially equally spaced from the edge 120 of the holding block.

In operation and with reference to FIG. 7, a pair of conductors may comprise a first conductor consisting of contact pad 96*a*, conductive path 72 and terminal 1, and a second conductor consisting of contact pad 96*b*, conductive path 74 and terminal 2. Signal current that enters pad 96*a* from a jack wire will travel along conductive path 72, out of terminal 1, return through terminal 2, and pass through conductive path 74 to the contacting jack wire. Even though the jack wires are connected to pad 100*b* (which is connected to pad 96*b*) and to pad 100*a* (which is connected to pad 96*a*), signal current does not flow through the pads which are normally connected to cross-talk compensating components. Thus, in accordance with the present invention, cross-talk compensating components are effectively present in the circuit but are not located in the current carrying path.

Although the invention has been described with respect to a specific embodiment, it shall be understood that this embodiment is exemplary only, and that it is contemplated that the described method and apparatus of the invention can be varied widely while still maintaining the advantages of the invention. Thus, the disclosure should not be taken as limiting in any way the scope of the invention.

Thus, while there has been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A telecommunication jack comprising:

a wire board having conductive pads; and at least one elongated arch shaped jack wire comprising a first leg member coupled to a second leg member via an apex member, the first leg member having a free end moveably coupled to the wire board and the second leg member having a free end moveably coupled to the wire board, wherein the free end of at least one leg member is coupled to a conductive pad on the wire board, at least one of the leg members being disposed to engage a contact of a mating plug that is moveable into and out of engagement with the at least one leg member, said free ends being configured to maintain contact with the wire board as the plug is moved into and out of said engagement.

2. The telecommunication jack of claim 1, wherein one leg member is adapted to engage the mating plug contact at a location other than the free end and the apex member.

3. The telecommunication jack of claim 1, wherein the first leg has a length that is longer than a length of the second leg.

4. The telecommunication jack of claim 1, wherein the first and second legs are of substantially equal length.

5. The telecommunication jack of claim 1, wherein the first conductive pad is coupled to a signal path and the second conductive pad is coupled to cross-talk compensating components.

6. The telecommunication jack of claim 1, further comprising:

a holding block having a top surface, a bottom surface and a passageway which extends through the holding block from the top surface to the bottom surface, the passageway in the holding block being positioned around the jack where the apex and portions of the first and second legs project beyond the top surface of the holding block.

7. The telecommunication jack of claim 6, wherein the passageway at the top surface of the holding block is substantially rectangular in cross-section with a longer rectangular dimension in a direction of motion of the mating plug when engaging the jack wire.

8. The telecommunication jack of claim 7, wherein a width of the passageway slidably receives the arch shaped jack wire.

9. The telecommunication jack of claim 8, wherein the free end of the first leg engages a first conductive pad on the wire board, and the free end of the second leg engages a second conductive pad on the wire board.

10. The telecommunication jack of claim 8, wherein the free ends of the first and second legs are free to spread apart when the mating plug engages a leg member.

11. The telecommunication jack of claim 10, wherein the free end of the first leg is coupled to the holding block which restricts its displacement on the wire board when the first leg is engaged by the mating plug.

12. The telecommunication jack of claim 11, wherein the free end of the first leg coupled to the holding block is hook shaped.

13. The telecommunication jack of claim 12, wherein the holding block supports an engaging member for engaging the hook shaped end of the first leg.

14. The telecommunication jack of claim 13, wherein the hook shaped end of the first leg is moveably coupled to the engaging member of the holding block such that the free end of the second leg is free to slide on the wire board when the first leg is engaged by the mating plug.

15. A telecommunication jack comprising:

a wire board having conductive pads;

a first elongated arch shaped jack wire comprising a first leg member coupled to a second leg member via an apex member, the first leg member having a free end moveably coupled to the wire board and the second leg member having a free end moveably coupled to the wire board, wherein the free end of at least one leg member is coupled to a conductive pad on the wire board and the first leg member is adapted to be engaged at a location between the free end and the apex member by a contact of a mating jack;

a second elongated arch shaped jack wire comprising a third leg member coupled to a fourth leg member via an apex member, the third leg member having a free end moveably coupled to the wire board and the fourth leg member having a free end moveably coupled to the wire board, wherein the free end of at least one leg member is coupled to a conductive pad on the wire board and the third leg member is adapted to be engaged at a location between the free end and the apex member by a contact of a mating jack;

a first conductive pad on the wire board electrically coupled to the free end of the first leg of the first jack wire;

a second conductive pad on the wire board electrically coupled to the free end of the second leg of the first jack wire;

a third conductive pad on the wire board electrically coupled to the free end of the third leg of the second jack wire; and a fourth conductive pad on the wire board electrically coupled to the free end of the fourth leg of the second jack wire, wherein the first and third conductive pads arc coupled to a common signal path and the second and fourth conductive pads are coupled to cross-talk compensating components.

16. The telecommunication jack of claim 15, wherein the first and third conductive pads are substantially spaced from an edge of the wire board.

17. The telecommunication jack of claim 15, wherein the first and third conductive pads are spaced at different distance from an edge of the wire board.

18. A telecommunication jack, comprising:

a wire board having conductive pads; and at least one elongated arch shaped jack wire comprising a first leg member coupled to a second leg member via an apex member, the first leg member having a free end moveably coupled to the wire board and the second leg member having a free end moveably coupled to the wire board, wherein the free end of at least one leg member is coupled to a conductive pad on the wire board, at least one of the leg members being disposed to engage a contact of a mating plug that is moveable in a sideways direction into engagement with the at least one leg member and to lower the apex member as the plug is moved further in said direction.

* * * * *